US012414618B2

(12) United States Patent
Bilquez et al.

(10) Patent No.: US 12,414,618 B2
(45) Date of Patent: Sep. 16, 2025

(54) LIPSTICK REFILL

(71) Applicant: APTAR FRANCE SAS, Le Neubourg (FR)

(72) Inventors: Sébastien Bilquez, Marcilly sur Eure (FR); Alex Milian, Les Baux de Breteuil (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 18/037,140

(22) PCT Filed: Nov. 15, 2021

(86) PCT No.: PCT/FR2021/052011
§ 371 (c)(1),
(2) Date: May 16, 2023

(87) PCT Pub. No.: WO2022/106775
PCT Pub. Date: May 27, 2022

(65) Prior Publication Data

US 2024/0000215 A1 Jan. 4, 2024

(30) Foreign Application Priority Data

Nov. 17, 2020 (FR) ..... 2011776

(51) Int. Cl.
*A45D 40/16* (2006.01)
*A45D 40/02* (2006.01)
(Continued)

(52) U.S. Cl.
CPC ..... *A45D 40/16* (2013.01); *A45D 40/02* (2013.01); *A45D 40/023* (2013.01); *A45D 40/12* (2013.01);
(Continued)

(58) Field of Classification Search
CPC ..... A45D 40/02; A45D 40/023; A45D 40/12; A45D 40/16; A45D 2040/0037; A45D 2040/0062
(Continued)

(56) References Cited

U.S. PATENT DOCUMENTS 2,071,747 A 2/1937 Houlihan et al.
2,770,358 A 11/1956 Keith et al.
(Continued)

FOREIGN PATENT DOCUMENTS

EP 0 726 042 A1 8/1996
FR 1124179 A 10/1956
JP WO 8602812 A1 * 5/1986

OTHER PUBLICATIONS

International Preliminary Report on Patentability (with translation of Written Opinion) dated May 16, 2023 in Application No. PCT/FR2021/052011.
(Continued)

*Primary Examiner* — Jennifer C Chiang
(74) *Attorney, Agent, or Firm* — Sughrue Mion, PLLC

(57) ABSTRACT

Lipstick refill having a cup, a stick of lipstick received in the cup so as to jointly form a refill entity, and a case in which the refill entity is fixedly and removably received, the case forming a longitudinal indentation. The cup is provided with a push-button radially projecting on the outside of the case and passing through said longitudinal indentation.

17 Claims, 7 Drawing Sheets

Figure 1A:
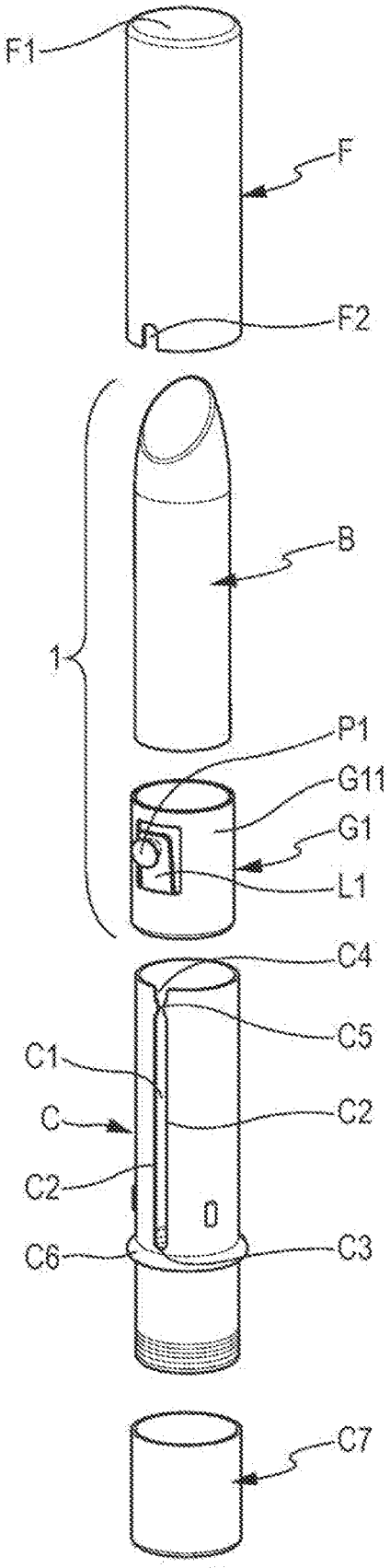

(51) Int. Cl.
*A45D 40/12* (2006.01)
*A45D 40/00* (2006.01)

(52) U.S. Cl.
CPC ..... *A45D 2040/0037* (2013.01); *A45D 2040/0062* (2013.01)

(58) Field of Classification Search
USPC ..... 401/55
See application file for complete search history.

(56) References Cited

U.S. PATENT DOCUMENTS

| | | | | |
|---|---|---|---|---|
| 4,182,945 | A * | 1/1980 | McArdle | A45D 40/02 206/385 |
| 6,623,198 | B2 * | 9/2003 | Holloway | A45D 40/12 401/78 |
| 11,517,097 | B2 * | 12/2022 | Lin | A45D 40/12 |

OTHER PUBLICATIONS

International Search Report for PCT/FR2021/052011 dated Feb. 18, 2022.

* cited by examiner

LIPSTICK REFILL

This Application is a National Stage of International Application No. PCT/FR2021/052011 filed Nov. 15, 2021, claiming priority based on French Patent Application No. 2011776 filed Nov. 17, 2020.

The present invention relates to a lipstick refill comprising a cup and a stick of lipstick received in the cup, so as to jointly form a refill entity. The refill also comprises a case in which the refill entity is held in position, but removably. The refill entity is intended to be transferred from the case into a lipstick mechanism which comprises a receiving sleeve adapted to slidingly receive the refill entity. This receiving sleeve has the particularity of forming a longitudinal window in which the push-button of the cup is manually movable, in order to make the stick exit from or enter the receiving sleeve.

In the prior art, document U.S. Pat. No. 2,770,358 is known, which describes a lipstick mechanism of this type, with a receiving sleeve forming a longitudinal window in which the push-button of a cup is manually movable. The stick which is packaged in a bag is placed in the cup of the lipstick mechanism by the user. It can be noted that the longitudinal window of the receiving sleeve is open at its lower end and forms a bottom at its upper end. The longitudinal window forms notches and the push-button of the cup comprises two small strips, that can be resiliently brought together between the thumb and the index finger, so as to be able to release and move the cup into the sleeve.

The disadvantage with this bagged refill is that it is difficult to handle it without the fingers coming into contact with the stick, once the bag is opened. In addition, it is not easy to insert the stick in the cup. The refilling operation is therefore both messy and difficult.

In the prior art, document FR1124179A is also known, which describes a refill comprising a cup provided with a lug which is engaged in a vertical slot formed in a protective case. This lug does not have the purpose of being handled by the user, but simply of being engaged in two grooves (axial and spiral) of a lipstick mechanism. This document actually specifies that the case (cover) is removed before engaging the cup on the mechanism in order to insert the lug in the grooves. The contact with the stick is thus unavoidable.

The invention aims to overcome the disadvantages of the prior art by proposing a lipstick refill which avoids any contact with the stick and the placing of which in the lipstick mechanism is easy and guaranteed.

To do this, the present invention proposes a lipstick refill comprising a cup, a stick of lipstick received in the cup, so as to jointly form a refill entity and a case in which the refill entity is fixedly and removably received, the case forming a longitudinal indentation, characterised in that the cup is provided with a push-button which radially projects on the outside of the case by passing through this longitudinal indentation.

The longitudinal indentation fulfils several functions: the first being to block the refill entity in the case. Indeed, the engagement of the push-button in the indentation considerably reduces its degree of freedom in the case. The second function of the indentation is to be able to see the positioning of the push-button to facilitate its transfer in the longitudinal window of the receiving sleeve of the lipstick mechanism. The user can very simply align the longitudinal indentation on the longitudinal window to prepare the transfer of the refill entity. Then, the user pushes the push-button to move it from the longitudinal indentation in the lipstick mechanism. The push-button therefore constitutes the member dedicated to the transfer of the refill entity, of the refill in the lipstick mechanism.

According to a very interesting feature of the invention, a substantially cylindrical annular space can be defined between the refill entity and the case. This annular space makes it possible for the receiving sleeve of the lipstick mechanism to be engaged inside the case around the cup. This space is not necessarily annular over the whole periphery of the cup. Indeed, the cup can be offset in the case, such that it can be brought closer or even come into contact with the internal wall of the case. It remains true that the space, thus in the form of a crescent moon, is almost fully annular. Advantageously, the annular space is passed through by the push-button. In other words, the annular space is present at the level where the push-button extends through the indentation of the case.

Advantageously, the indentation defines an upper bottom opposite a lower opening, the push-button being abutted against the upper bottom and/or blocked in the indentation in the proximity of the upper bottom, for example by a narrowing or an equivalent profile. Thus, the refill entity is fully blocked in position in the case, thanks to its push-button blocked in the indentation. It can, for example, be provided that the part of the push-button which extends between the two side edges of the indentation is wedged between the two side edges at the level of a local narrowing of the indentation or also that the two side edges form two respective bosses in the proximity of the upper bottom which make it possible to hold the push-button by removable snap-fitting. The push-button can be abutted against the bottom of the indentation and blocked in this position by clamping between the two side edges or snap-fitting beyond two bosses. It can also be considered to block the push-button in the indentation only by clamping between the two side edges, advantageously in the proximity of the bottom.

According to an embodiment, a slider can be disposed in this annular space, this slider being movable by sliding in the case around the refill entity. This slider fulfils a spacer or strut function by guaranteeing a fully annular space between the case and the cup. The upper edge of the receiving sleeve can thus be easily engaged in the case around the cup in this well-formed annular space. Then, the upper edge of the receiving sleeve comes into contact with the slider. An additional pushing of the upper edge of the receiving sleeve on the slider will lead to the sliding movement of the slider around the cup, but without pressed contact, then around the stick, without contact with anything, in order to not mark it during handling. At the end position, the slider is positioned at the bottom of the case.

According to another embodiment, the cup can form resilient tabs which block access to this annular space, the resilient tabs being radially retracted inwards under a stress to free up access to the annular space. Preferably, the cup is thus made of plastic material. It is the upper edge of the receiving sleeve which will exert the necessary stress on the resilient tabs to then be able to access the subsequent annular space. The resilient tabs fulfil three functions: holding the cup in the case, centring the cup in the case to guarantee an annular space and blocking this annular space and the case. According to an embodiment, the cup can form resilient pins which enable, with the resilient tabs, to hold the cup centrally in the case. In a variant, the cup can form resilient tabs forming bosses which are axially offset and which come into contact with the case, thus holding the cup centrally in the case.

Also, according to another embodiment, the case can internally define a lower section of increased diameter and an upper section of reduced diameter, the annular space being defined between the cup and the lower section of increased diameter, the annular space being passed through by the push-button, the cup extending to the inside of the upper section of reduced diameter. Thus, the upper edge of the receiving sleeve can penetrate into the lower section of increased diameter until abutting against the start of the upper section of reduced diameter. This, however, is sufficient to engage the push-button in the longitudinal window of the receiving sleeve.

According to another aspect of the invention, the cup can form a resilient blocking strip which radially projects outwards in the rest state, the push-button being integral with this resilient blocking strip, a press on the push-button making it possible to resiliently move the resilient blocking strip radially inwards. Once the refill entity is transferred into the receiving sleeve of the lipstick mechanism, this strip will press against the case to block the refill entity in place. To move the refill entity, the user must press on the push-button to deform the strip inwards before urging the push-button upwards or downwards in the longitudinal window. This strip can be formed in a metal or plastic material cup.

According to an embodiment, the cup can be pushed by the resilient blocking strip against the case so as to define a crescent moon-shaped annular space, the cup forming an access profile which is separated from the case, this access profile being advantageously disposed diametrically opposite the resilient blocking strip. This access profile can also be qualitied as an insertion ramp, chamfer or insertion space: it enables the upper edge of the receiving sleeve to navigate a passage between the case and the cup. Without this access profile, the upper edge of the receiving sleeve would really come up against the bottom of the cup and the insertion of the sleeve around the cup would not be possible. Thanks to this feature, the upper edge of the receiving sleeve can be engaged between the case and the cup and repel the cup against the resilient blocking strip to navigate a path by completing the annular space. This access profile is particularly advantageous when the cup is made of plastic material. Indeed, the cup can thus be held in the case by leaving the resilient blocking strip at rest, i.e. without stress. The strip simply pushes the cup towards the case without actually pressing. The access profile makes it possible to move the cup towards the indentation by slightly deforming the strip from its rest position. It is, in this case, advantageous to block the push-button in the indentation by means of a removable clamping or snap-fitting, such as defined above, given that the strip at rest does not contribute to holding the cup in the case.

In contrast, it is also considerable that the resilient blocking strip is resiliently stressed against the internal side edges of the indentation. The cup is thus rather made of metal. The strip can even abut against an internal profile of the case, in addition to the push-button abutted at the bottom of the indentation.

More generally, the case can comprise at least one abutted internal profile against which the cup is abutted to limit the insertion of the refill entity in the case, this abutted internal profile being advantageously formed as one piece by the case in the form of a cut-out or a groove.

The invention also defines an assembly comprising a lipstick mechanism and at least one lipstick refill such as defined above, the lipstick mechanism comprising a receiving sleeve adapted to receive the refill entity of the lipstick refill, this receiving sleeve forming a longitudinal window defining a lower bottom opposite an upper opening, the lipstick refill being returned onto the receiving sleeve with the indentation aligned with the longitudinal window to transfer by sliding the push-button of the indentation in the longitudinal window through its upper opening, thus moving the refill entity of the case in the receiving sleeve. Advantageously, the receiving sleeve penetrates into the case around the refill entity, the push-button being engaged in the longitudinal window through its upper opening.

Naturally, the transfer of the push-button from the indentation to the window can only be done with the alignment of the indentation and of the window, that the user can easily do, since the indentation is very visible, just like the window. In addition, the indentation is open downwards and the window is open upwards.

The engagement of the push-button in the longitudinal window occurs preferably during the insertion of the receiving sleeve inside the case around the cup: the push-button remaining in place in the indentation, for example abutted against its bottom. The sleeve can be sunk in the case until the refill entity has reached its starting position in the receiving sleeve. In a variant, the sleeve can be sunk in the case until the refill entity has reached an intermediate position in the receiving sleeve. The user must thus handle the push-button to bring it into starting position in the receiving sleeve. However, it is not excluded that the engagement of the push-button in the longitudinal window results from the handling of the push-button by the user, who will then bring it into starting position in the receiving sleeve.

The scope of the invention also relates to include the cup in the refill entity with the stick, different from document U.S. Pat. No. 2,770,358, in which only the stick is bagged. The longitudinal indentation with its holding, blocking and locating functions, in association with the push-button, mounted on a strip or not, is particularly advantageous. The annular space, even if it can be crescent moon-shaped, is another particularly advantageous feature. A separate protection, independent from the indentation and from the push-button, could be sought. A case containing a cup (plus a stick) with a space between the case and the cup for the engagement of the receiving sleeve constitutes an independent inventive concept. Likewise, a separate protection, independent from the indentation and from the push-button, could be sought for a lipstick mechanism, the longitudinal window of the receiving sleeve of which is open at its upper end and forms a bottom at its lower end.

The invention will now be further described in reference to the accompanying drawings, giving as non-limiting examples, several embodiments of the invention.

Figure 1B:
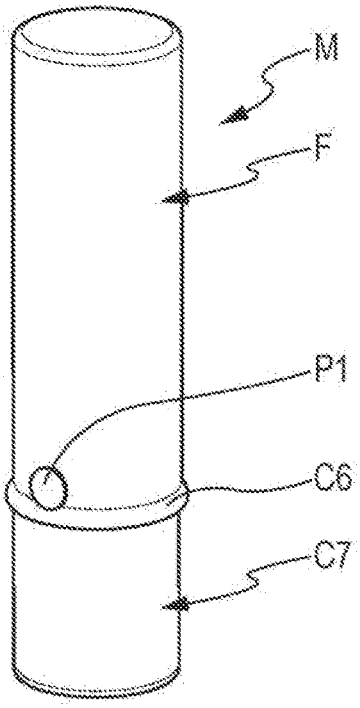
Figure 2A:
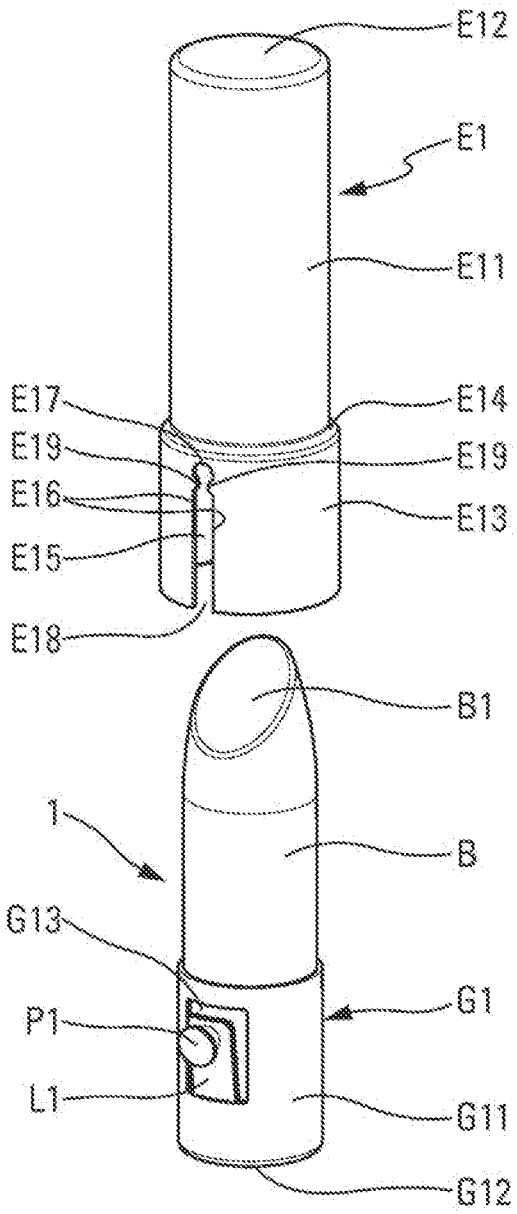
Figure 2B:
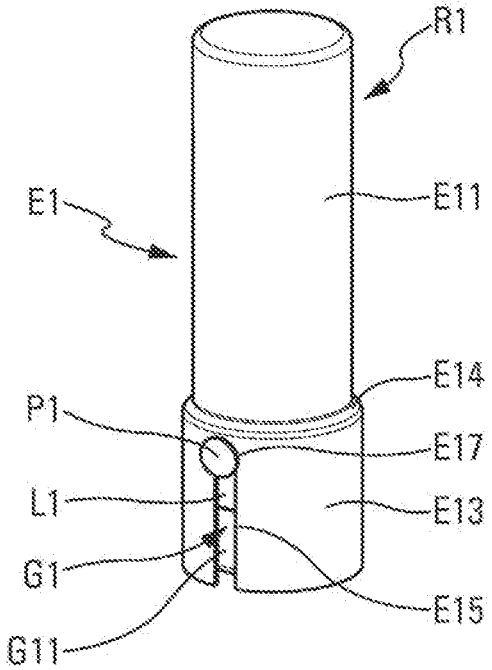
Figure 2C:
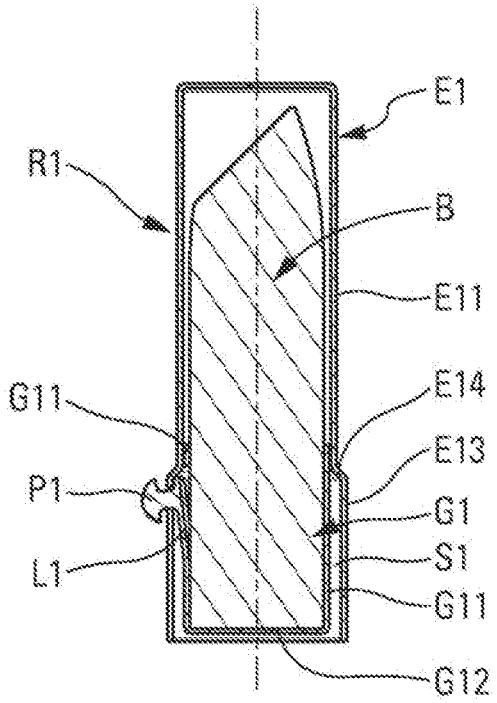
Figure 3A:
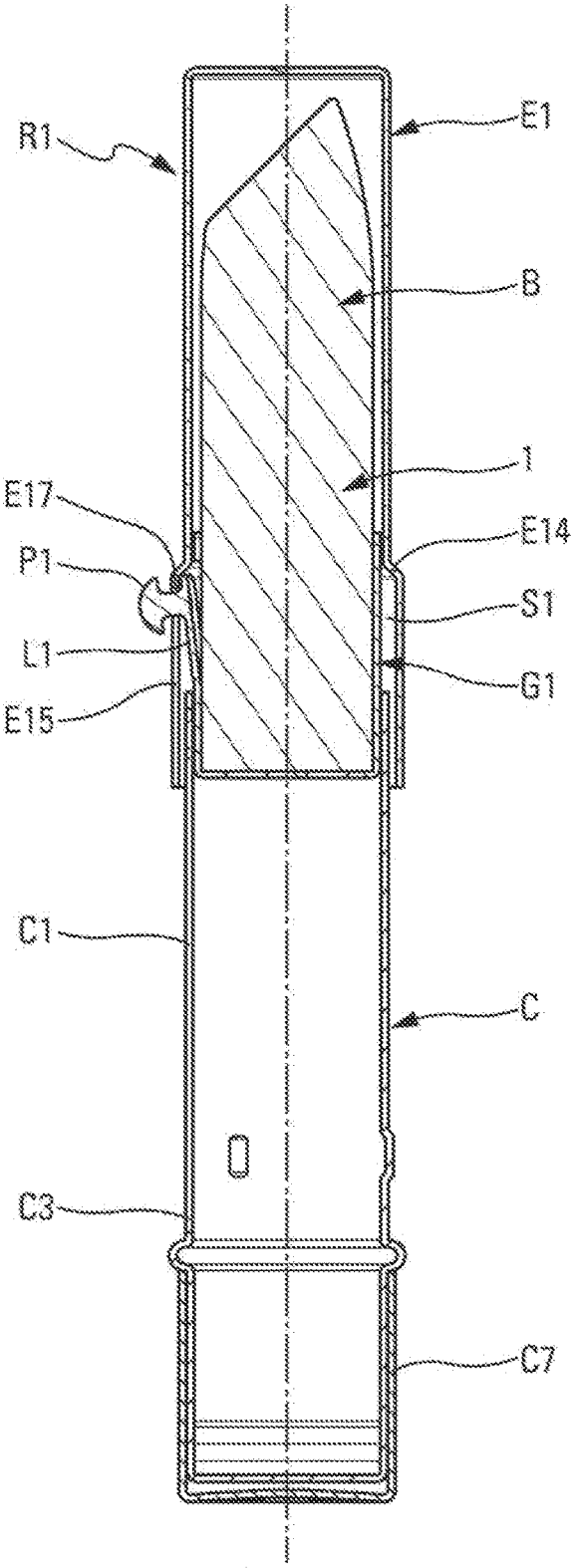
Figure 3B:
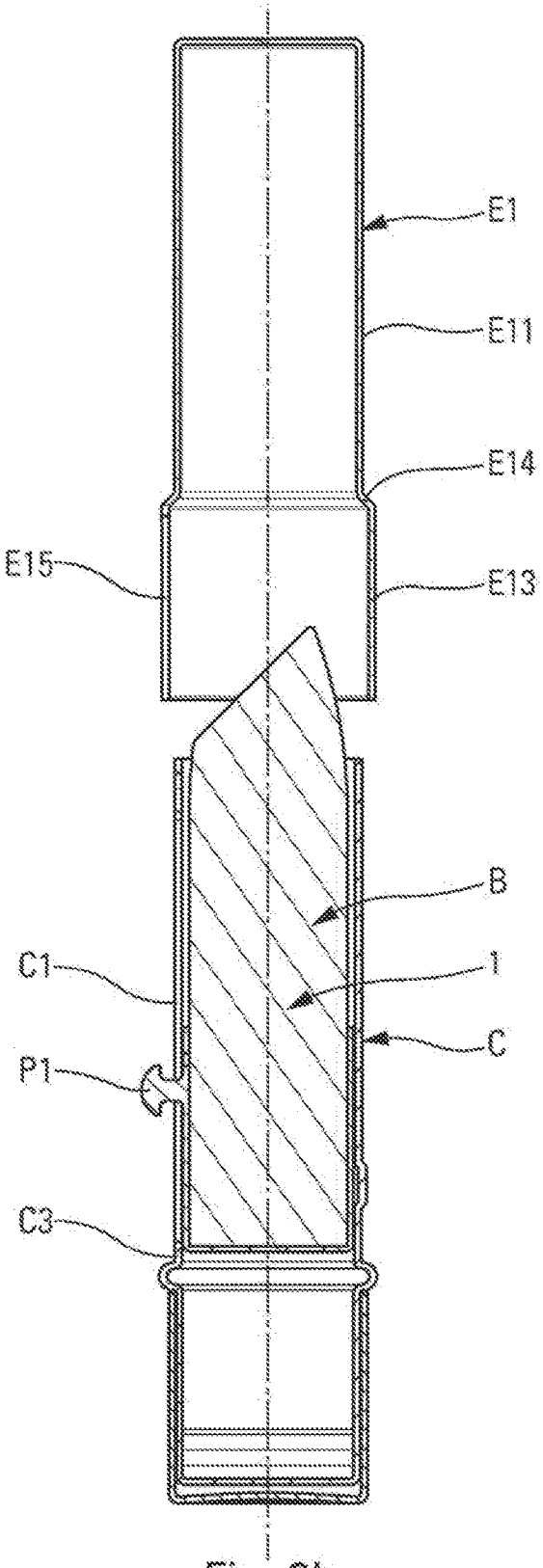
Figure 4A:
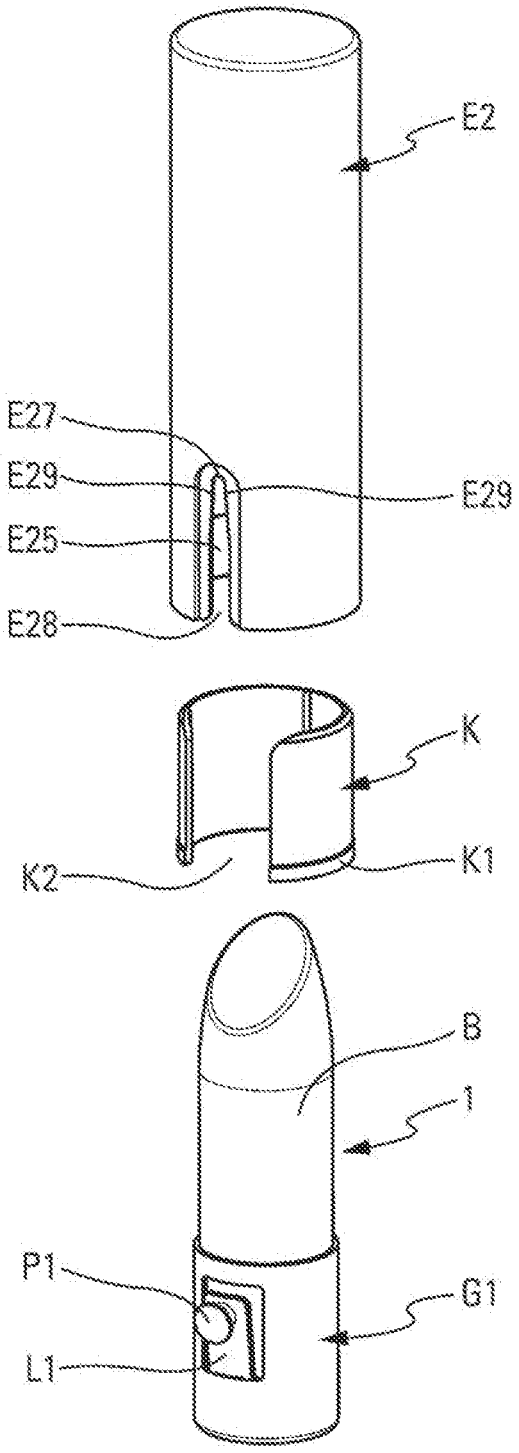
Figure 4B:
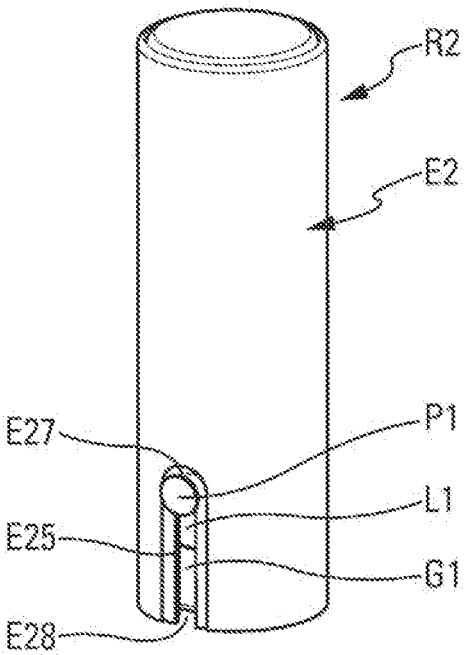
Figure 4C:
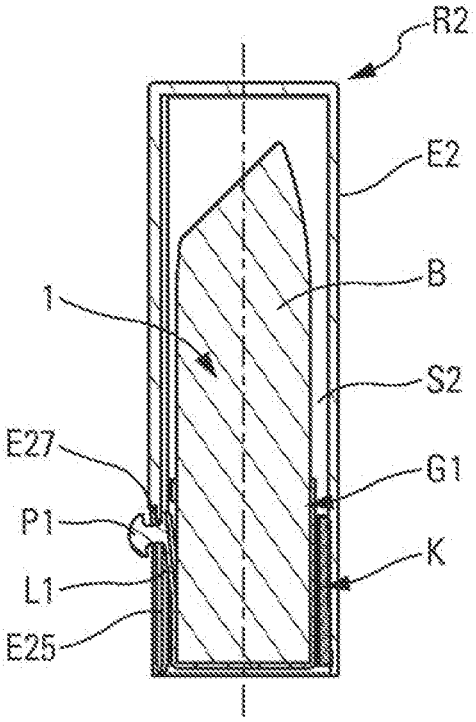
Figure 5A:
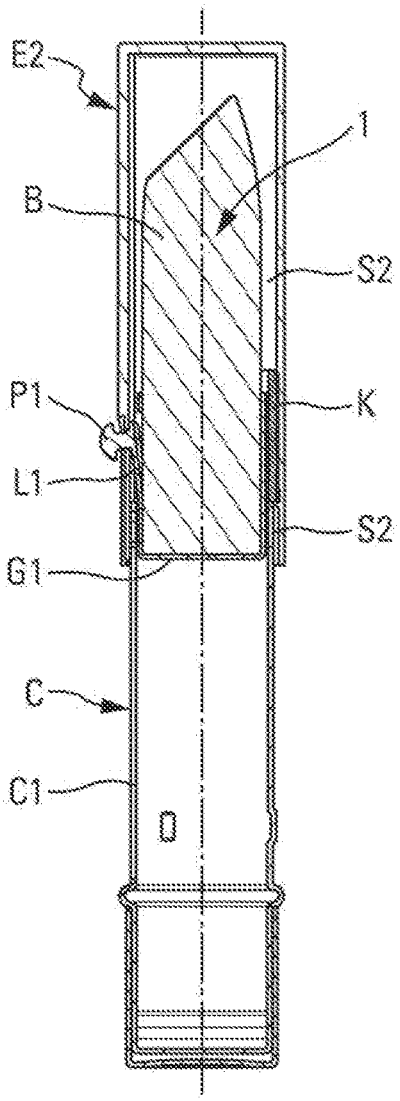
Figure 5B:
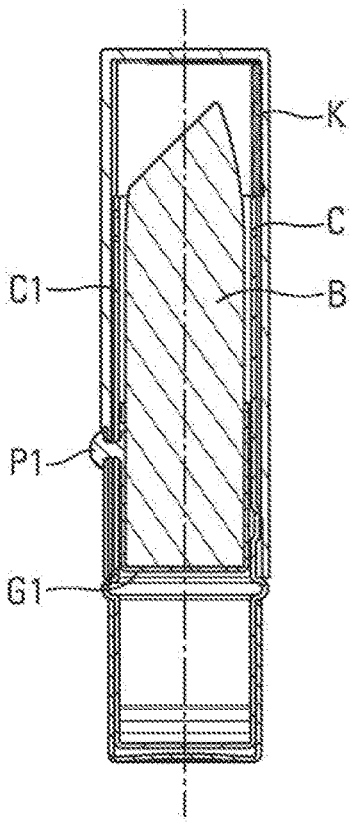
Figure 5C:
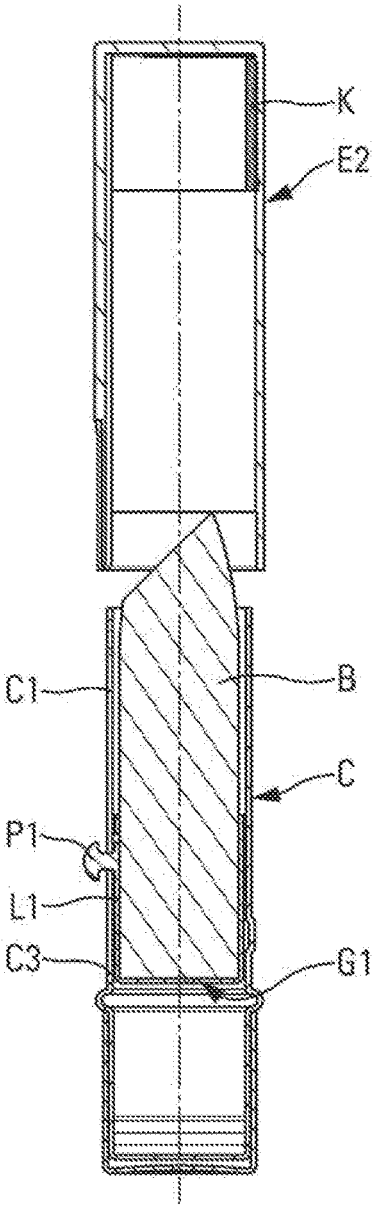
Figure 6A:
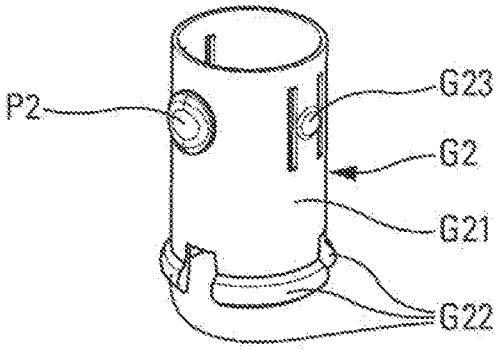
Figure 6E:
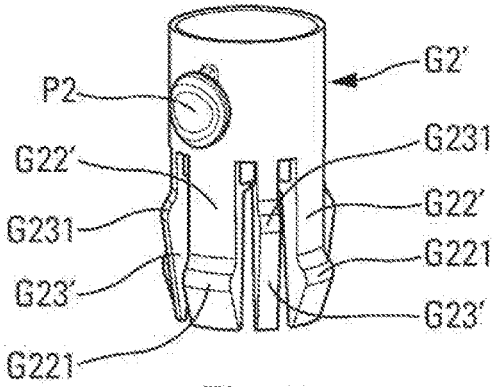
Figure 6B:
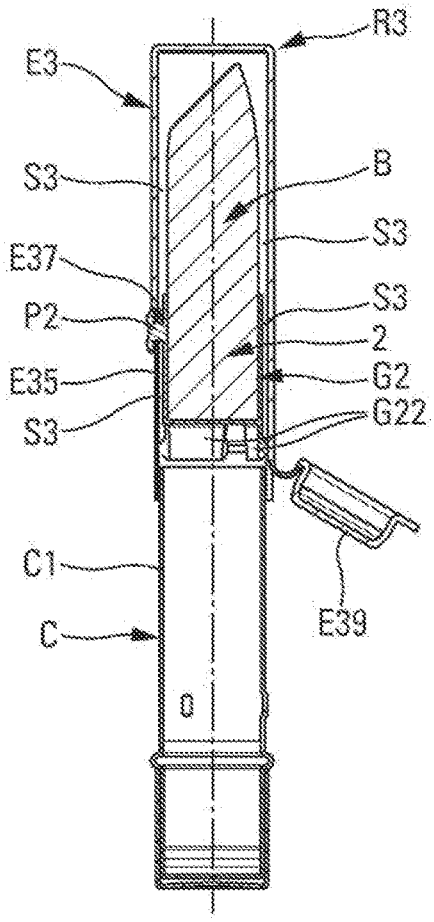
Figure 6C:
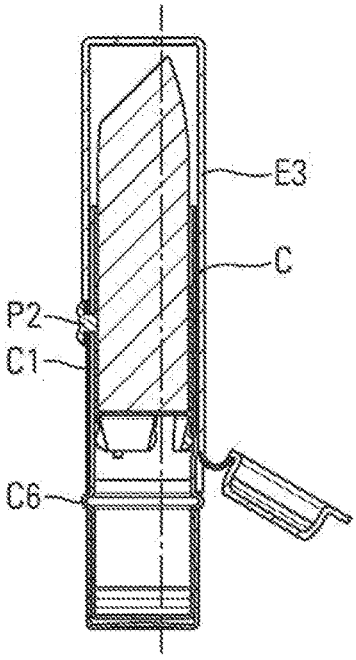
Figure 6D:
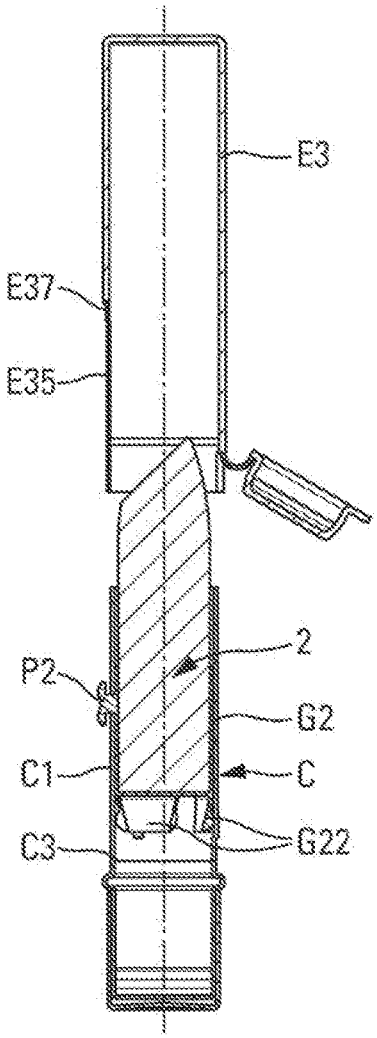
Figure 7A:
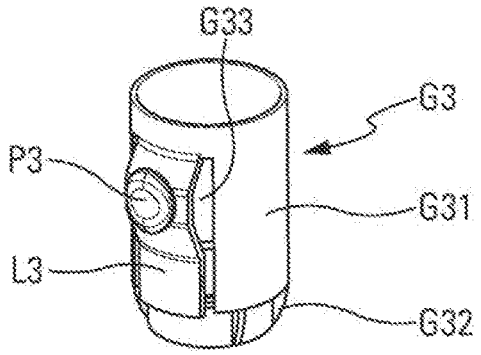
Figure 7B:
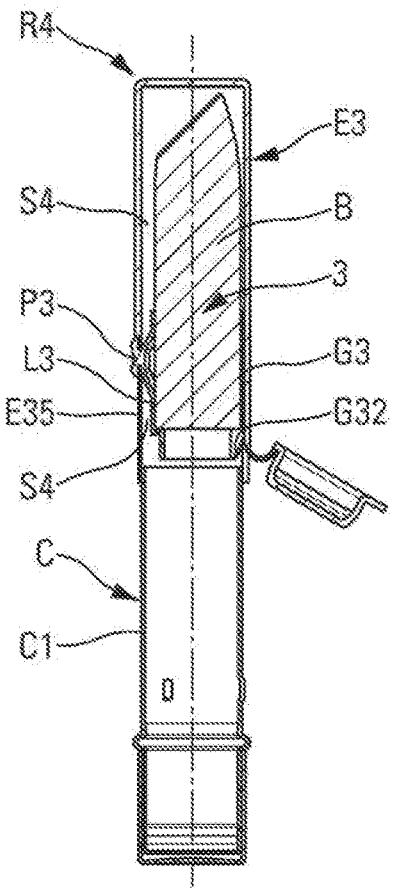
Figure 7C:
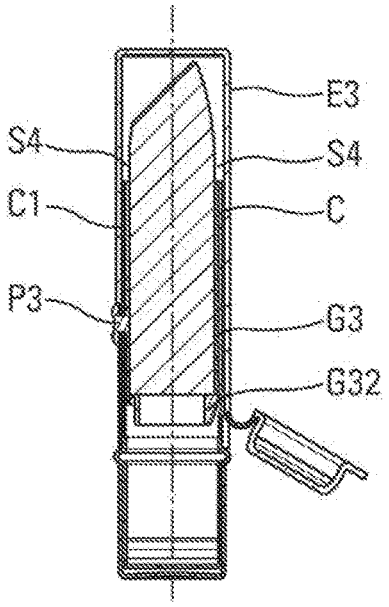
Figure 7D:
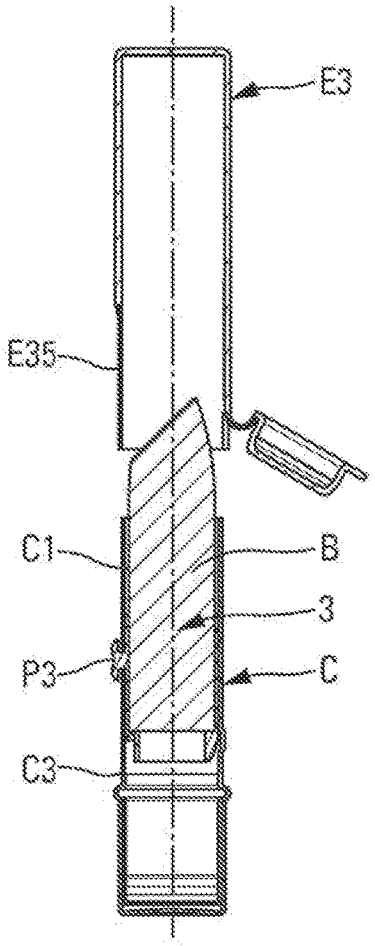

In the figures:

FIG. 1*a* is an exploded perspective view of a lipstick mechanism of the invention, FIG. 1*b* is a perspective view in the raised state of the lipstick mechanism of FIG. 1*a*, FIG. 2*a* is an exploded perspective view of a lipstick refill according to a first embodiment of the invention, FIG. 2*b* is a perspective view in the mounted state of the lipstick refill of FIG. 2*a*, FIG. 2*c* is a vertical cross-sectional view through the lipstick refill of FIG. 2*b*, FIG. 3*a* is a vertical cross-sectional view through a lipstick mechanism ready to receive a refill entity coming from the lipstick refill of FIGS. 2*a* to 2*c*, FIG. 3*b* is a view similar to that of FIG. 3*a* with the refill entity transferred in the lipstick mechanism, FIG. 4*a* is an exploded perspective view of a lipstick refill according to a second embodiment of the invention, FIG. 4*b* is a perspective view in the mounted state of the lipstick refill of FIG. 4*a*, FIG. 4*c* is a vertical cross-sectional view through the lipstick refill of FIG. 4*b*, FIGS. 5*a*, 5*b* and 5*c* illustrate a transfer operation of the lipstick refill of FIGS. 4*a* to 4*c* in a lipstick mechanism, FIG. 6*a* is a perspective view of a cup according to another embodiment of the invention, FIGS. 6*b*, 6*c* and 6*d* illustrate the transfer of a lipstick refill according to a third embodiment of the invention to a lipstick mechanism, FIG. 6*e* is a view similar to that of FIG. 6*a* for a variant of the embodiment, FIG. 7*a* is a perspective view of a cup also according to another embodiment of the invention, and FIGS. 7*b*, 7*c* and 7*d* illustrate the transfer of a lipstick refill according to a fourth embodiment to a lipstick mechanism.

The lipstick refill of the invention is intended for the replacement of the stick of a lipstick mechanism which has the following features. Rather than driving the axial raising and descent of the stick in the sleeve by rotation of a rotary actuation ring, the lipstick mechanism M of the invention is simpler, since the axial raising and descent of the stick B is done by acting directly on an axial translative push-button which is integral with a cup in which the stick R is mounted.

More specifically, as can be seen in FIGS. 1*a* and 1*b*, the lipstick mechanism M of the invention comprises a substantially cylindrically-shaped receiving sleeve C. This sleeve C comprises a longitudinal window C1 which extends vertically over the main part of the height of the sleeve C. This window C1 is defined between two vertical side edges C2 which are mainly parallel. The window C1 comprises a lower bottom C3 and an upper opening C4. Optionally, a narrowing C5 can be provided in the proximity of the upper opening C4: the two side edges C2 simply form two small bosses oriented towards one another so as to create a localised narrowing of the window C1. Below the lower bottom C3, the sleeve C can form a projecting annular ridge C6. The sleeve C can be provided with a casing cap C7 which is engaged around the lower end of the sleeve. The casing cap C7 is preferably snap-fitted or definitively forcefully mounted. This casing cap C7 can extend until in contact with the projecting annular ridge C6. Although not represented, the two vertical side edges C2 can form blocking profiles, for example in the form of teeth at the level of the window C1 or also notches at the level of the internal wall of the sleeve C along the window C1.

The lipstick mechanism M of the invention also comprises a sheath F, closed at its upper end F1, which is removably engaged around the sleeve C. It can be held in place on the sleeve C by small relief profiles. The sheath F can come into contact with the projecting annular ridge C6. It can be noted that the lower edge of the sheath comprises a notch F2, which can be aligned with the window C1, such that it leaves the lower bottom C3 visible, when the sheath F is in place on the sleeve C.

The lipstick mechanism M of the invention further comprises a refill entity 1, 2, 3 which is slidingly and removably mounted in the receiving sleeve C. This refill entity comprises a cup and a stick B mounted in the cup. The stick B can have a conventional shape, mainly cylindrical with a bevelled and rounded upper end. The lower end of the stick B is set in the cup. As can be seen below, the cup can have different embodiments G1, G2, G3. In FIG. 1*a*, it is the first refill entity 1 with its cup G1 which is represented: it will be described in more detail below. All the refill entities 1, 2, 3 however have common features, in particular the stick B, but also at the level of the cups G1, G2, G3, such as a peripheral wall which surrounds the stick B and a side push-button P1, P3, P3 which radially projects outwards. When the refill entity 1 is in place in the sleeve C, the cup G1 is located inside the sleeve C with the side push-button P1 which passes through the longitudinal window C1 so as to be accessible and can be handled from the outside of the sleeve C. Thus, a user can make stick B rise and descend outside and inside the sleeve C by axially moving the push-button P1 along the window C1. In the low position, the push-button will abut against the lower bottom C3 of the window C1 and in the high position, the push-button P1 is stopped by the narrowing C5. However, it is possible to move the push-button P1 beyond the narrowing C5 by forcing a little. The push-button is thus positioned at the level of the upper opening C4 and the refill entity R can thus be extracted from the sleeve C.

According to the invention, the refill entity 1, 2, 3 forms an integral part of a lipstick refill R1, R2, R3 in association with a case E1, E2, E3 in which the refill entity is removably received. The stick B can be substantially identical in all embodiments and does not constitute a critical element of the invention, which is concentrated at the level of the cup G1, G2, G3 and of the case E1, E2, E3. Before describing in detail the various embodiments, it can first be noted that the lipstick refill R1, R2, R3, R4 of the invention integrates not only the stick B, but also the cup G1, G2, G3, which will serve to removably hold the refill entity 1, 2, 3 in the case E1, E2, E3 and enable the transfer of the refill entity to the receiving sleeve C of the lipstick mechanism M.

In reference to FIGS. 2*a*, 2*b*, 2*c*, 3*a* and 3*b*, the first embodiment for a lipstick refill R1 of the invention will now be described.

This refill R1 first comprises a refill entity 1, constituted of a stick B set in a cup G1, which is associated with a case E1 in which the refill entity 1 is received and removably held in place.

The stick B is presented in the form of a short stick of thick cosmetic product. Absolutely conventionally, the stick B can have a substantially ogival-shaped upper end cut by an inclined flat face. Its lower end is housed inside the cup G1, which comprises a substantially cylindrical side wall G11 and an optional bottom G12. The cup G1 also comprises a resilient blocking strip L1 disposed in a cut-out G13 formed in the side wall G11. This strip L1 is inclined outwards so as to project with respect to the side wall G11. In this embodiment, the strip L1 extends upwards and outwards. In a variant, the strip could also extend downwards and outwards. In the rest state, the blocking strip L1 is inclined outwards, but it is possible to shut it in the cut-out G13 by resilient deformation. This resilient blocking strip L1 supports a push-button P1 which itself also radially projects outwards from the external face of the strip L1. Thus, by radial pressing on the push-button P1, the strip L1 can be deformed so as to return it into the cut-out G13. This push-button P1 will also serve to move the refill entity 1 translationally in the sleeve C of the lipstick mechanism M described above. The stick B can be mechanically inserted inside the cup G1. In a variant, the stick B can be moulded or cast directly inside the cup G1.

The case E1 internally defines a receiving space to house the refill entity 1 there at the same time. This case E1 comprises an upper section of reduced diameter E11 and a lower section E13 of increased diameter. These two sections E11 and E13 are connected by a shoulder E14. The upper end E12 of the case E1 is closed, while its lower end is open. It can be noted that the lower section E13 is formed with a longitudinal indentation E15 which can extend over all or some of the height of the lower section E13. This longitudinal indentation E15 is defined between two parallel side edges E16. The indentation E16 comprises an upper bottom E17, in this case disposed in the proximity of the shoulder E14, as well as a lower opening E18. It is therefore possible to introduce an element in the indentation E16 through its lower opening E18 and to make it slide until abutting against its upper bottom E17. Optionally, a narrowing E19 can be provided in the proximity of the bottom E11 of the indentation E15: the two side edges E15 can form two bosses oriented towards one another so as to create a localised tapering of the indentation E16 in the proximity of the upper bottom E17.

According to the invention, the refill entity 1 is inserted inside the case E1 through the opening of its lower section E13, such that the push-button P1 passes through the indentation E16. The final mounting position is reached when the push-button P1 abuts against the upper bottom E17. It can be noted in FIGS. 2*b*, 2*c* that the push-button P1 radially projects outwards, outside of the indentation E15. It is therefore directly accessible by a user. The strip L1 is fully disposed inside the case E1. It can be in the rest state or slightly stressed so as to press or not against the internal wall of the lower section E13. In the final mounting position, as represented in FIG. 2*c*, the free upper end of the strip L1 can even abut against the shoulder E14. It can be noted that the upper edge of the cup G1 is engaged inside the upper section E11 of reduced section. This makes it possible to centre the cup G11 inside the lower section E13 so as to define a substantially cylindrical annular space S1 between the case E1 and the peripheral wall G11 of the cup G1. This annular space S1 is directly accessible by the open lower end of the case E1 around the bottom G12 of the cup G1.

The final mounting position of the refill entity 1 inside the case E1 is guaranteed by the abutment of the push-button P1 against the upper bottom E11 of the indentation E16. The blocking in final mounting position of the refill entity 1 inside the case E1 can be ensured either by the push-button P1 snap-fitted beyond the narrowing E19 of the indentation E15, or by the resilient pressing of the strip L1 against the lower wall of the lower section E13, or by the friction engagement of the upper end of the side wall G11 of the cup G1 inside the upper section E11. A combination of these different holdings is also possible.

The cup G1 and the case E1 can be made of any suitable material. However, a metal, in particular aluminium or steel embodiment, is preferred. The push-button P1 can be made of one piece with the strip and the side wall G11 when the cup is made of plastic material. When made of metal, the push-button P1 can be returned on the strip L1 which is made of one piece with the side wall G11. Without moving away from the scope of the invention, it can be imagined that the internal wall of the case E1 is staged, but not its external wall. This can, in particular, be made of plastic material.

Now, FIGS. 3*a* and 3*b* will be referred to, to explain how the refill entity 1 of the refill R1 is transferred from the case E1 into the sleeve C of the lipstick mechanism. In FIG. 3*a*, it can be seen that the upper end of the sleeve C is already engaged in the annular space S1 defined between the case E1 and the cup G1. As mentioned above, this annular space S1 exists beforehand in the refill R1 and thus enables the upper end of the sleeve C to be easily introduced in the case E1 around the cup G1. It can be said that this annular space constitutes a means for engaging or inserting the sleeve C in the refill R1. In FIG. 3*a*, the upper edge of the sleeve C is located substantially at the level of the base of the strip L1. It is understood that a deeper insertion of the sleeve C inside the case E1 will bring the sleeve C to stress the resilient strip L1 inwards into the cut-out G13. The sleeve C will thus be able to continue its insertion in the case E1 until its upper edge abuts against the push-button P1, in the case where the window C1 is not yet aligned with the indentation E15. Otherwise, when the alignment has been done beforehand, the sleeve C will continue its insertion into the case E1 until abutting against the shoulder E14, with the push-button P1 introduced inside the window C1. Advantageously, the push-button P1 is thus already engaged in the window F below the narrowing C5. It can be said that the refill entity 1 is thus in contact in the sleeve C. The user can thus press the push-button P1 to drive the refill entity 1 inside the sleeve C by sliding in the window C1 until abutting with its lower bottom C3. The user can then remove the case E1. In a variant, the case E1 can be removed as soon as the push-button P1 is inserted in the window C1. Then, the user will make the refill entity 1 slide inside the sleeve C by pressing on the push-button P1 that it slides into the window C1 until abutting against its bottom C3.

The longitudinal indentation E15 therefore makes it possible to fix the position of the refill entity 1 inside the case E1. The push-button P1 preferably abuts against the upper bottom E11 of the indentation E15. In a variant, the push-button P1 can be wedged between the two side edges E16 in the proximity of the upper bottom E17. A slight snap-fitting in the proximity of the bottom E11 can even be imagined, in order to block the push-button P1 inside the indentation 15. The visual alignment of the indentation E15 with the window C1 makes it possible for the user to very easily and rapidly transfer the refill entity 1 of the case E1 in the sleeve C.

FIGS. 4*a*, 4*b* and 4*c* show a second embodiment for a lipstick refill of the invention. The refill entity 1 is identical to that of the first embodiment, comprising a stick B set in a cup G1. The case E2 is not staged like in the first embodiment, but on the contrary, substantially or fully cylindrical at the level of its internal wall, and preferably also at the level of its external wall. The case E2 comprises a longitudinal indentation E25 defining an upper bottom E27 and a lower opening E28, just like in the first embodiment.

In this second embodiment, the refill R2 further comprises a slider K which can be presented in the form of a small cuff which is not complete, since it defines a passage K2. It can also be noted that the lower edge of the slider K can form a holding bead K1. This slider K is intended to be engaged around the cup G1 with the passage K2 receiving the strip L1. The slider K can also be inserted inside the case. Just like in the first embodiment, when the refill entity 1 is in place in the case, the push-button P1 is engaged in the indentation E25 until abutting against its upper bottom E27. Optionally, the side edges of the indentation E25 can progressively move closer to one another in the proximity of the upper bottom E27 to create a narrowing E29 in order to hold the push-button P1 in position by clamping or in the proximity of the bottom E27. The cup G1 and the strip L1 can be observed through the indentation E25, as can be seen in FIG. 4*d*. The slider K is disposed between the cup G1 and the case E2, as can be seen in FIG. 4*c*. The slider K with its bead K1 can contribute to holding the refill entity 1 inside the case E2. The slider K also makes it possible to define an annular space S2 between the refill entity 1 and the case E2.

FIGS. 5*a*, 5*b* and 5*c* will now be referred to, to describe how the refill entity 1 is transferred from the case E2 into the sleeve C of a lipstick mechanism. In FIG. 5*a*, the upper end of the sleeve C is already engaged inside the case around the cup G1. This is possible, as the slider K can be moved by sliding inside the case E2 around the refill entity 1, by starting with its cup G1. It can be observed that the sliding movement of the slider K has cleared an annular space between the case E2 and the cup G1 in which the upper end of the sleeve C is engaged. The sinking of the sleeve C inside the case E2 can first be continued by deforming the strip L1 inwards, then by engaging the push-button P1 inside the window C1. The sinking of the sleeve C in the case E2 will continue until the slider K abuts against the top of the case E2, as can be seen in FIG. 5*b*. The push-button P1 has thus already travelled more than half the height of the window C1 of the sleeve C. The user can thus press the push-button 1, sink it and drive it until in contact with the bottom C3 of the window C1. The case E2 can thus be removed with its captive slider K.

Just like in the first embodiment, an annular space is created to receive the sleeve C and engage the push-button P1 in the window C1 of the sleeve. Although the push-button A1 does not come into contact with the bottom C3 in these two embodiments, a variant can be considered in which the sleeve C has no bead C6, thus enabling the push-button P1 abutted against the bottom E11 of its indentation E15 to reach the bottom C3 of the sleeve.

The case E2 with its slider K can be made of any suitable material, and preferably made of plastic material.

FIGS. 6*a*, 6*b*, 6*c* and 6*d* illustrate a third embodiment for a lipstick refill of the invention. The refill entity 2 differs from the preceding embodiment at the level of its cup G2, which is more visible in FIG. 6*a*. This cup G2 is preferably made of plastic material, for example aliphatic polyketone. It comprises a side wall G21, but has no bottom. The side wall G21 forms a push-button P2, which is not intended to be sunk, but simply to be grasped for an axial movement. The side wall G21 also comprises two resilient pins G23 which will come into friction contact with the inside of the sleeve C of the lipstick mechanism. It can also be noted that the lower end of the cup G2 forms resilient tabs or segments G22 which are separated by slots. These resilient tabs G22 project outwards at rest. However, they can be moved under stress, radially inwards.

The cup G2 is also adapted to receive a stick B to jointly form the refill entity 2. The latter is represented in FIG. 6*b* engaged inside a case E3 which forms a longitudinal indentation E35 ended with an upper bottom E37. The indentation E35 can be substantially similar or identical to those of the preceding embodiments. The case E3 is characterised in this case, by the addition of a stopper E39 which makes it possible to removably block its bottom. It can be noted that the push-button P2 is engaged in the indentation E35 until abutted against its bottom E37. On the other hand, the resilient tabs G22 and the resilient pins G23 come into slight contact with the inside of the case E3. These resilient tabs G22 and resilient pins G23 thus contribute to the axial holding of the refill entity 2 inside the case E3. They also make it possible to define an annular space S3 between the refill entity 2 and the case E3 by centring the cup G2 inside the case E3. It can thus be said that the resilient tabs G22 and the resilient pins G23 form axial centring or guiding means.

In FIG. 6*b*, the upper end of the sleeve C can be seen already engaged inside the case E3. It is understood that the upper edge of the sleeve C will come into contact with the resilient tabs G22. Due to their flexibility, these tabs will be stressed by the upper edge of the sleeve C inwards, as represented in FIG. 6*c*. The engagement of the sleeve C inside the case E3 can thus be continued by engaging the push-button P2 in the window C1 of the sleeve C. This engagement is ended when the lower edge of the case E3 abuts against the bead C6 of the sleeve C, this is represented in FIG. 6*c*. Subsequently, the user can remove the case E3 and press the push-button P2 until it abuts against the bottom C3 of the window C1 of the sleeve C.

It must be noted that the movement of the cup G2 inside the sleeve C is done only by friction at the pins G23 and the resilient tabs G22. The push-button P2 is not intended to be sunk to release the movement of the cup G21, as was the case in the two first embodiments with the resilient blocking strip L1.

In FIG. 6*e*, a variant of an embodiment of the cup G2 can be seen, which is referenced G2': this cup G2' can be used instead of the cup G2 in the case E3. Just like the cup G2, this cup G2' can be made of aliphatic polyketone. It comprises a side wall G21', which can have no bottom. The side wall G21' forms a push-button P2, which is not intended to be sunk, but simply to be grasped for an axial movement. The side wall G21' also comprises resilient tabs G22' and G23' which are disposed alternately and separated by slots. The resilient tabs G22' form bosses G221 and the resilient tabs G23' form bosses G231. These bosses G221 and G231 radially project outwards. The bosses G221 are axially offset with respect to the bosses G231. The tabs G22' and G23' are stressed radially inwards, when the cup G2' is inserted in the case E3. They also make it possible to define an annular space S3 between the refill entity 2 and the case E3 by centring the cup G2' inside the case E3. It can thus be said that the resilient tabs G22' and G23' form axial centring or guiding means.

The fourth embodiment for a lipstick refill is represented in FIGS. 7*a*, 7*b*, 7*c* and 7*d*. The lipstick refill 3 of this embodiment comprises a stick B, as well as a cup G3, which is more visible in FIG. 7*a*. This cup G3 also comprises a side wall G31 forming a cut-out G33 in which a resilient blocking strip L3 extends, on which a push-button P3 is formed. Thus, by radial pressing on the push-button P3, the strip L3 is deformed and is radially moved inwards into the cut-out G33. This embodiment can be considered as a variant of the cup G1. However, it can be noted that the strip L3 extends downwards, and not upwards, as in the cup G1. The cup G3 also forms an access profile G32, which can be presented in the form of a chamfered or rounded edge. Its function will be given below.

The cup G3 is preferably made by injection moulding plastic material, but it can also be made of metal. It receives a stick B to form a lipstick refill 3.

In FIG. 7*b*, this refill 3 can be seen in place in a case E3, which can be substantially similar or identical to that of the third embodiment. The push-button P3 is engaged in the indentation E35 until its bottom, just like in the preceding embodiments. It can also be noted that the strip L3 is not deformed: it is substantially in its rest state. It can also be seen that the refill entity 3 is offset or off-centre on the right inside the case E3. Indeed, the right edge of the cup G3 is in contact with the case E3, while its left edge where the strip L3 is formed is removed from the case E3. Thus, a crescent moon-shaped substantially annular space S4 is defined between the cup G3 and the case E3. This annular space S4 is also defined around the stick B. The access profile G32 is located at the level where the cup G3 is in contact with the case E3. In FIG. 7*b*, the upper edge of the sleeve C is already engaged inside the case E3. It is thus easily understood that the access profile G32 will facilitate the engagement of the sleeve C around the cup by offsetting it leftwards inside the case E3. It can also be said that this access profile G32 enables the upper edge of the sleeve C to navigate a path between the cup G3 and the case E3 by offsetting it leftwards, which has the effect of deforming the strip L3. The sleeve C can thus continue its insertion inside the case E3 by also further deforming the strip L3, as can be seen in FIG. 7*c*. The engagement of the sleeve in the case E3 thus makes it possible to make the annular space S4 pass from a crescent moon shape into a fully annular shape. All that remains, is for the user to move the push-button P3 to the bottom C3 of the window C1. The case E3 can be removed before or after this operation.

It must be noted that the resilient strip L3 is not stressed inside the case E3, such that it does not risk being deformed by creeping. The push-button P3 can be held in the indentation E35 by clamping between these side edges or also by a slight snap-fitting, as described above. The axial offsetting of the refill entity 3 inside the case E3 is not impeding, insofar as the sleeve C can, all the same, be inserted around the refill entity 3 thanks to the access profile G32 which avoids a direct abutment of the sleeve C against the cup G3.

The four embodiments which have just been described make it possible to highlight two significant features which can be implemented independently, namely the indentation of the case, which makes it possible to house the push-button and the annular space between the refill entity and the case there, which makes it possible to engage the sleeve around the refill entity to collect it. The engagement of the push-button in the window of the sleeve C, while the push-button is also engaged at the bottom in the indentation of the case is another significant feature of the invention. Likewise, in all the embodiments, the annular space is passed through by the push-button. The push-button can simply abut against the bottom of the indentation and/or be blocked against the bottom or in the proximity of it by any suitable reversible blocking means, like a narrowing of the indentation, a thickening of the edge of the indentation, the pressing of the strip against the internal wall of the case, a friction between the cup and the case, etc. It has been seen that the cup can be made of metal or made of plastic material, with or without resilient blocking strip.

Thanks to the invention, a lipstick refill is available, integrating a refill entity constituted of a cup and a stick which can be transferred from a case into the sleeve of a sliding lipstick mechanism without risk of contact with the stick. A box comprising a lipstick mechanism associated with several identical or different lipstick refill can, for example, be considered.

The invention claimed is:

1. A lipstick refill comprising:

a cup, a stick of lipstick received in the cup, so as to jointly form a refill entity, a case in which the refill entity is fixedly and removably received, the case forming a longitudinal indentation, wherein the cup is provided with a push-button which radially projects on the outside of the case by passing through this longitudinal indentation;

wherein the indentation defines an upper bottom opposite a lower opening, the push-button being abutted against the upper bottom and/or blocked in the proximity of the upper bottom.

2. The lipstick refill according to claim 1, wherein a substantially cylindrical annular space is defined between the refill entity and the case.

3. The lipstick refill according to claim 1, wherein the annular space is passed through by the push-button.

4. The lipstick refill according to claim 1, wherein a slider is disposed in this annular space, this slider being movable by sliding in the case around the refill entity.

5. The lipstick refill according to claim 1, wherein the cup forms resilient tabs which block access to this annular space, the resilient tabs are radially retracted inwards under a stress to free up access to the annular space.

6. The lipstick refill according to claim 5, wherein the cup forms resilient pins, which make it possible, with the resilient tabs to hold the cup centrally in the case.

7. The lipstick refill according to claim 5, wherein the cup forms resilient tabs forming bosses which are axially offset and which come into contact with the case, thus holding the cup centrally in the case.

8. The lipstick refill according to claim 1, wherein the case internally defines a lower section of increased diameter and an upper section of reduced diameter, the annular space being defined between the cup and the lower section of increased diameter, the annular space being passed through by the push-button, the cup extending up to the inside of the upper section of reduced diameter.

9. The lipstick refill according to claim 1, wherein the cup forms a resilient blocking strip which radially projects outwards in the rest state, the push-button being integral with this resilient blocking strip, a pressing on the push-button making it possible to resiliently move the resilient blocking strip radially inwards.

10. The lipstick refill according to claim 9, wherein the cup is pushed by the resilient blocking strip against the case so as to define a crescent moon-shaped annular space, the cup forming an access profile which is separated from the case, this access profile being advantageously disposed diametrically opposite the resilient blocking strip.

11. The lipstick refill according to claim 9, wherein the resilient blocking strip is resiliently stressed against the case.

12. An assembly comprising a lipstick mechanism and at least one lipstick refill according to claim 1, the lipstick mechanism comprising a receiving sleeve adapted to receive the refill entity of the lipstick refill, this receiving sleeve forming a longitudinal window defining a lower bottom opposite an upper opening, the lipstick refill being returned on the receiving sleeve with the longitudinal indentation aligned with the longitudinal window to transfer by sliding the push-button of the indentation in the longitudinal window through its upper opening, thus moving the refill entity of the case in the receiving sleeve.

13. The assembly according to claim 12, wherein the receiving sleeve is configured to penetrate into the case around the refill entity, the push-button being engaged in the longitudinal window through its upper opening.

14. The lipstick refill according to claim 1, wherein the longitudinal indentation is a slot.

15. The lipstick refill according to claim 1, wherein the case has an integrally formed one-piece construction top portion that closes a top distal end of the case.

16. The lipstick refill according to claim 1, wherein a distal top end of the lipstick is blocked from protruding from the case.

17. A lipstick refill comprising:

a cup, a stick of lipstick received in the cup, so as to jointly form a refill entity, a case in which the refill entity is fixedly and removably received, the case forming a longitudinal indentation, wherein the cup is provided with a push-button which radially projects on the outside of the case by passing through this longitudinal indentation;

wherein the cup is fixed to a bottom of the stick of lipstick and extends upwards along less than half an axial length of the lipstick; and wherein the stick of lipstick is received through an opening on a bottom of the case and is blocked from axial protruding from a top of the case.

* * * * *